US011999539B2

(12) United States Patent
Costanzo, Jr.

(10) Patent No.: US 11,999,539 B2
(45) **Date of Patent: *Jun. 4, 2024**

(54) CORRUGATED CARDBOARD COOLER

(71) Applicant: BRRR BOX, LLC, Fort Mill, SC (US)

(72) Inventor: Donn J. Costanzo, Jr., Fort Mill, SC (US)

(73) Assignee: BRRR BOX, LLC, Fort Mill, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/203,050

(22) Filed: May 29, 2023

(65) Prior Publication Data

US 2023/0356877 A1 Nov. 9, 2023

Related U.S. Application Data

(63) Continuation of application No. 17/571,530, filed on Jan. 9, 2022, now Pat. No. 11,667,429.

(60) Provisional application No. 63/274,518, filed on Nov. 1, 2021, provisional application No. 63/158,334, filed on Mar. 8, 2021.

(51) Int. Cl.

| | |
|---|---|
| ***B65D 5/468*** | (2006.01) |
| ***B65D 5/44*** | (2006.01) |
| *B65D 5/24* | (2006.01) |
| *B65D 5/36* | (2006.01) |
| *B65D 5/56* | (2006.01) |

(52) U.S. Cl.

CPC ..... *B65D 5/4608* (2013.01); *B65D 5/443* (2013.01); *B65D 5/241* (2013.01); *B65D 5/3678* (2013.01); *B65D 5/563* (2013.01)

(58) Field of Classification Search

CPC .. B65D 81/38; B65D 81/3848; B65D 81/386; B65D 5/241; B65D 5/46112; B65D 5/443; B65D 5/6629; B65D 5/6635; B65D 5/4608

USPC ..... 229/117.13, 117.16–17; 206/427

See application file for complete search history.

(56) References Cited

U.S. PATENT DOCUMENTS

| | | | | |
|---|---|---|---|---|
| 6,736,309 | B1 * | 5/2004 | Westerman | B65D 5/46144 229/148 |
| 7,487,904 | B2 * | 2/2009 | McClure | B65D 5/3678 229/920 |
| 7,743,970 | B2 * | 6/2010 | Bates | B65D 5/0227 206/427 |
| 9,085,385 | B1 * | 7/2015 | Costanzo, Jr. | B31B 50/26 |

(Continued)

*Primary Examiner* — Nathan J Newhouse
*Assistant Examiner* — Phillip D Schmidt
(74) *Attorney, Agent, or Firm* — TILLMAN WRIGHT, PLLC; Chad D. Tillman

(57) ABSTRACT

A box is made by folding a sheet of material. Preferably, the box is formed by applying adhesive and folding using a machine, and a waterproof or water-resistant coating is applied to the sheet of material so that the box is configured for use as a cooler. The box includes: a storage portion, including a bottom panel, first and second end panels, and first and second side panels; four corner panels; and first and second top panels. The top panels include openings that register when the box is assembled and in a closed configuration to define an opening to be used as a handhold for gripping the box. Reinforcing panels of one of the top panels includes flaps located on an interior of the box that cover the handhold opening. The box further preferably includes a locking tab and locking panel for latching closed the top panels of the box.

15 Claims, 5 Drawing Sheets

(56) References Cited

U.S. PATENT DOCUMENTS

| | | | | |
|---|---|---|---|---|
| 11,214,428 | B2 * | 1/2022 | Costanzo, Jr. | B65D 5/241 |
| 2006/0273142 | A1 * | 12/2006 | Pierce | B65D 5/029<br>229/109 |
| 2015/0001251 | A1 * | 1/2015 | Smith | B65D 5/16<br>493/93 |
| 2020/0270013 | A1 * | 8/2020 | Costanzo, Jr. | B65D 5/643 |

* cited by examiner

CORRUGATED CARDBOARD COOLER

CROSS-REFERENCE TO RELATED APPLICATION

The present application claims priority to, and is a non-provisional patent application of, each of 63/274,518, which is incorporated herein by reference; and 63/158,334, which is incorporated herein by reference. Additionally, U.S. patent application publication 2020/0140179 is incorporated herein by reference.

COPYRIGHT STATEMENT

Any new and original work of authorship in this document is subject to copyright protection under the copyright laws of the United States and other countries. Reproduction by anyone of this document as it appears in official governmental records is permitted, but otherwise all other copyright rights whatsoever are reserved.

BACKGROUND OF THE INVENTION

The present invention is believed to represent one or more improvements over coolers such as those disclosed in U.S. Pat. No. 9,469,433, which is incorporated herein by reference.

An embodiment of the '433 patent comprises a cooler formed from a folded sheet of material—sometimes referred to as a "blank"—having a water resistant or waterproof coating applied thereto. The folded sheet of material comprises a bottom panel, side panels, end panels, and corner panels, which panels are configured to collectively form a storage area of the cooler when the sheet is folded. The folded sheet of material further comprises a handle segment with a locking tab; a lid segment; and a locking panel that is adapted to receive the locking tab of the handle segment for locking engagement of the handle segment. Additionally, a fold line extends between and divides the locking panel and one of the corner panels.

While the cooler disclosed in the '433 patent is useful for its intended purpose, it is believed that it would be beneficial to have one or more alternative designs for coolers formed from a folded sheet of material having a water resistant or waterproof coating applied thereto. One or more embodiments of the present invention represent such an alternative design.

SUMMARY OF THE INVENTION

The present invention relates to a box and, more preferably, to a box used as a cooler for containing ice for keeping items cool, including for example beverages or food.

In preferred embodiments, the cooler is made from a corrugated material and, preferably, a single sheet of corrugated material such as cardboard that is folded into an assembled cooler configuration. The cooler when in the assembled cooler configuration preferably is transitionable between a collapsed configuration for storage, shipping, disposal, or recycling after use, and/or retail sale; and an expanded configuration for use in keeping items cool.

In an aspect, a blank for assembly of a box comprises bottom panel, a first end panel and a second end panel, a first side panel and a second side panel, and four corner panels. Additionally, the blank further comprises: a first top panel comprising a first finger opening for receiving fingers therethrough; a locking panel comprising an opening, wherein a fold line extends between and separates the first top panel and the locking panel; first and second reinforcing panels, wherein a fold line extends between and separates the first reinforcing panel and the first top panel, and wherein a fold line extends between and separates the second reinforcing panel and the first top panel; a second top panel comprising a second finger opening for receiving fingers therethrough, the first and second finger openings registering with each other to define a handhold opening when the box is assembled and in a closed configuration; third and fourth reinforcing panels, wherein a fold line extends between and separates the third reinforcing panel and the second top panel, and wherein a fold line extends between and separates the fourth reinforcing panel and the second top panel; a locking tab, wherein the opening of the locking panel is sized and dimensioned to receive the locking tab therethrough; and first and second flaps, with a fold line extending between and separating the first flap and the third reinforcing panel, and a fold line extending between and separating the second flap and the fourth reinforcing panel, wherein the first and second flaps at least initially cover the handhold opening when the box is assembled and in a closed configuration.

In another aspect, a blank for assembly of a box comprises a bottom panel, a first end panel and a second end panel, a first side panel and a second side panel, and four corner panels. Additionally, the blank further comprises: a first top panel comprising a first finger opening for receiving fingers therethrough; a second top panel comprising a second finger opening for receiving fingers therethrough, the first and second finger openings registering with each other to define a handhold opening when the box is assembled and in a closed configuration; first and second reinforcing panels, wherein respective fold lines extend between and separate the reinforcing panels and the second top panel; and first and second flaps, with a fold line extending between and separating the first flap and the first reinforcing panel, and a fold line extending between and separating the second flap and the second reinforcing panel, wherein the first and second flaps are configured to extend across and cover the handhold opening when the box is assembled and in a closed configuration.

In another aspect, a blank for assembly of a box comprises a bottom panel, a first end panel and a second end panel, a first side panel and a second side panel, and four corner panels. Additionally, the blank further comprises: a first top panel comprising a first finger opening for receiving fingers therethrough; a second top panel comprising a second finger opening for receiving fingers therethrough, the first and second finger openings registering with each other to define a handhold opening when the box is assembled and in a closed configuration; first and second reinforcing panels, wherein respective fold lines extend between and separate the reinforcing panels and the second top panel; and a locking tab and locking panel for latching the top panels of the box when in a closed configuration, wherein a fold line extends between and separates the first top panel and the locking pane, and wherein an opening of the locking panel is sized and dimensioned to receive the locking tab therethrough. [oil] In yet another aspect, a blank for assembly of a box comprises a bottom panel, first and second end panels, first and second side panels, and four corner panels. Additionally, the blank further comprises: a first top panel comprising a first finger opening for receiving fingers therethrough; a second top panel comprising a second finger opening for receiving fingers therethrough, the first and second finger openings registering with each other to define a handhold opening when the box is assembled and in a closed configuration; first and second reinforcing panels, wherein respective fold lines extend between and separate the reinforcing panels and the second top panel; and a locking tab and locking panel for latching the first and second top panels of the box when in a closed configuration, wherein the locking panel is located along a side edge of the first top panel midway between the first and second reinforcing panels, and the locking tab is located midway along the second top panel between the third and fourth reinforcing panels.

In a feature of this aspect, the blank further comprises third and fourth reinforcing panels, wherein a fold line extends between and separates the third reinforcing panel and the second top panel, and wherein a fold line extends between and separates the fourth reinforcing panel and the second top panel. Moreover, the blank further comprises first and second flaps, with a fold line extending between and separating the first flap and the third reinforcing panel, and a fold line extending between and separating the second flap and the fourth reinforcing panel, wherein the first and second flaps at least initially cover the handhold opening when the box is assembled and in a closed configuration.

In a feature of the foregoing aspects, each fold line that extends between and separates a said flap and reinforcing panel is a line of perforations.

In a feature of the foregoing aspects, the first and second top panels are located at opposite ends of the blank.

In a feature of the foregoing aspects, a waterproof or water-resistant coating is applied to a surface of the blank for use of the box as a cooler.

In a feature of the foregoing aspects, the blank comprises one or more additional fold lines by which a box when assembled is collapsible. Preferably the one or more additional fold lines extend across a middle of each end panel and the bottom panel of the blank.

In a feature of the foregoing aspects, the blank consists of a single sheet of corrugated cardboard for making the box by gluing and folding.

In a feature of the foregoing aspects, the blank comprises a single sheet of corrugated cardboard for making the box by gluing and folding.

In another aspect, a box is formed by folding and gluing a blank made from a single sheet of corrugated cardboard, wherein a top panel of the box comprises an opening defining a handhold for holding the box and wherein the box further comprises means for covering the opening of the handhold.

In another aspect, a box comprises: a storage portion, including a bottom panel, first and second end panels, and first and second side panels; four corner panels; a first top panel comprising a first finger opening for receiving fingers therethrough; a locking panel comprising an opening, wherein a fold line extends between and separates the first top panel and the locking panel; first and second reinforcing panels, wherein a fold line extends between and separates the first reinforcing panel and the first top panel, and wherein a fold line extends between and separates the second reinforcing panel and the first top panel; a second top panel comprising a second finger opening for receiving fingers therethrough, the first and second finger openings registering with each other to define a handhold opening when the box is in a closed configuration; third and fourth reinforcing panels, wherein a fold line extends between and separates the third reinforcing panel and the second top panel, and wherein a fold line extends between and separates the fourth reinforcing panel and the second top panel; a locking tab, wherein the opening of the locking panel is sized and dimensioned to receive the locking tab therethrough; and first and second flaps, with a fold line extending between and separating the first flap and the third reinforcing panel, and a fold line extending between and separating the second flap and the fourth reinforcing panel, wherein the first and second flaps at least initially cover the handhold opening when the box is in a closed configuration.

In another aspect, a box comprises: a storage portion, including a bottom panel, first and second end panels, and first and second side panels; four corner panels; a first top panel comprising a first finger opening for receiving fingers therethrough; a second top panel comprising a second finger opening for receiving fingers therethrough, the first and second finger openings registering with each other to define a handhold opening when the box is in a closed configuration; first and second reinforcing panels, wherein respective fold lines extend between and separate the reinforcing panels and the second top panel; and first and second flaps, with a fold line extending between and separating the first flap and the first reinforcing panel, and a fold line extending between and separating the second flap and the second reinforcing panel, wherein the first and second flaps are configured to extend across and cover the handhold opening when the box is in a closed configuration.

In another aspect, a box comprises: a storage portion, including a bottom panel, first and second end panels, and first and second side panels; four corner panels; a first top panel comprising a first finger opening for receiving fingers therethrough; a second top panel comprising a second finger opening for receiving fingers therethrough, the first and second finger openings registering with each other to define a handhold opening when the box is in a closed configuration; first and second reinforcing panels, wherein respective fold lines extend between and separate the reinforcing panels and the second top panel; and a locking tab and locking panel for latching the top panels of the box when in a closed configuration, wherein a fold line extends between and separates the first top panel and the locking pane, and wherein an opening of the locking panel is sized and dimensioned to receive the locking tab therethrough.

In another aspect, a box comprises: a storage portion, including a bottom panel, first and second end panels, and first and second side panels; four corner panels; a first top panel comprising a first finger opening for receiving fingers therethrough; a second top panel comprising a second finger opening for receiving fingers therethrough, the first and second finger openings registering with each other to define a handhold opening when the box is in a closed configuration; first and second reinforcing panels, wherein respective fold lines extend between and separate the reinforcing panels and the second top panel; and a locking tab and locking panel for latching the first and second top panels of the box when in a closed configuration, wherein the locking panel is located along a side edge of the first top panel midway between the first and second reinforcing panels, and the locking tab is located midway along the second top panel between the third and fourth reinforcing panels.

In a feature of the foregoing aspect, the box further comprises third and fourth reinforcing panels, wherein a fold line extends between and separates the third reinforcing panel and the second top panel, and wherein a fold line extends between and separates the fourth reinforcing panel and the second top panel. Additionally, the box further comprises first and second flaps, with a fold line extending between and separating the first flap and the third reinforcing panel, and a fold line extending between and separating the second flap and the fourth reinforcing panel, wherein the first and second flaps at least initially cover the handhold opening when the box is in a closed configuration.

In a feature of the foregoing aspects regarding a box, each fold line that extends between and separates a said flap and reinforcing panel is a line of perforations.

In a feature of the foregoing aspects regarding a box, the first and second top panels are located at opposite ends of the blank.

In a feature of the foregoing aspects regarding a box, a waterproof or water-resistant coating is applied to a surface of the blank for use of the box as a cooler.

In a feature of the foregoing aspects regarding a box, the box comprises one or more additional fold lines by which the box is collapsible. Preferably, the one or more additional fold lines extend across a middle of each end panel and the bottom panel of the blank.

In a feature of the foregoing aspects regarding a box, the box is made by folding and gluing a blank that consists of a single sheet of corrugated cardboard for making the box by gluing and folding.

In a feature of the foregoing aspects regarding a box, the box is made by folding and gluing a blank that comprises a single sheet of corrugated cardboard for making the box by gluing and folding.

In another aspect, a box is formed by folding and gluing a blank made from a single sheet of corrugated cardboard, wherein a top panel of the box comprises an opening defining a handhold for holding the box and wherein the box further comprises means for covering the opening of the handhold.

In another aspect, a box made by folding a sheet of material comprises: a storage portion, including a bottom panel, first and second end panels, and first and second side panels; four corner panels; first and second top panels, wherein the first and second top panels comprise openings that register when the box is assembled and in a closed configuration to define an opening to be used as a handhold for gripping the box; and first and second reinforcing panels, wherein respective fold lines extend between and separate the reinforcing panels and the second top panel; and first and second flaps located on an interior of the box when in a closed configuration, with a fold line extending between and separating the first flap and the first reinforcing panel, and a fold line extending between and separating the second flap and the second reinforcing panel, wherein the first and second flaps are configured to extend across and cover the handhold opening when the box is assembled and in the closed configuration.

In a feature of the foregoing aspect, the box comprises a locking tab and locking panel for latching the top panels of the box when in a closed configuration.

In another aspect, a box made by folding a sheet of material comprises: a storage portion, including a bottom panel, first and second end panels, and first and second side panels; four corner panels; and first and second top panels, wherein the top panels comprise openings that register when the box is closed to define an opening to be used as a handhold for gripping the box; and a locking tab and locking panel for latching the top panels of the box when in a closed configuration, wherein the locking panel is located along a side edge of the first top panel midway between the first and second end panels, and the locking tab is located midway along the second top panel between the first and second end panels.

In a feature of the foregoing aspect, one of the top panels comprises flaps located on an interior of the box that cover the handhold opening.

Yet another aspect relates to a method of gluing and folding a blank of any of the preceding aspects and features. Still another aspect relates to a box made by gluing and folding the blank of any of the foregoing aspects and features.

Additional aspects and features of the invention are disclosed in the drawings, and still additional aspects and features of the invention are disclosed in the incorporated U.S. patent application publication and priority applications.

In addition to the aforementioned aspects and features of the present invention, it should be noted that the present invention further encompasses the various logical combinations and subcombinations of such aspects and features. Thus, for example, claims in a nonprovisional application or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

One or more preferred embodiments of the present invention now will be described in detail with reference to the accompanying drawings, wherein the same elements are referred to with the same reference numerals.

DETAILED DESCRIPTION

Figure 1:
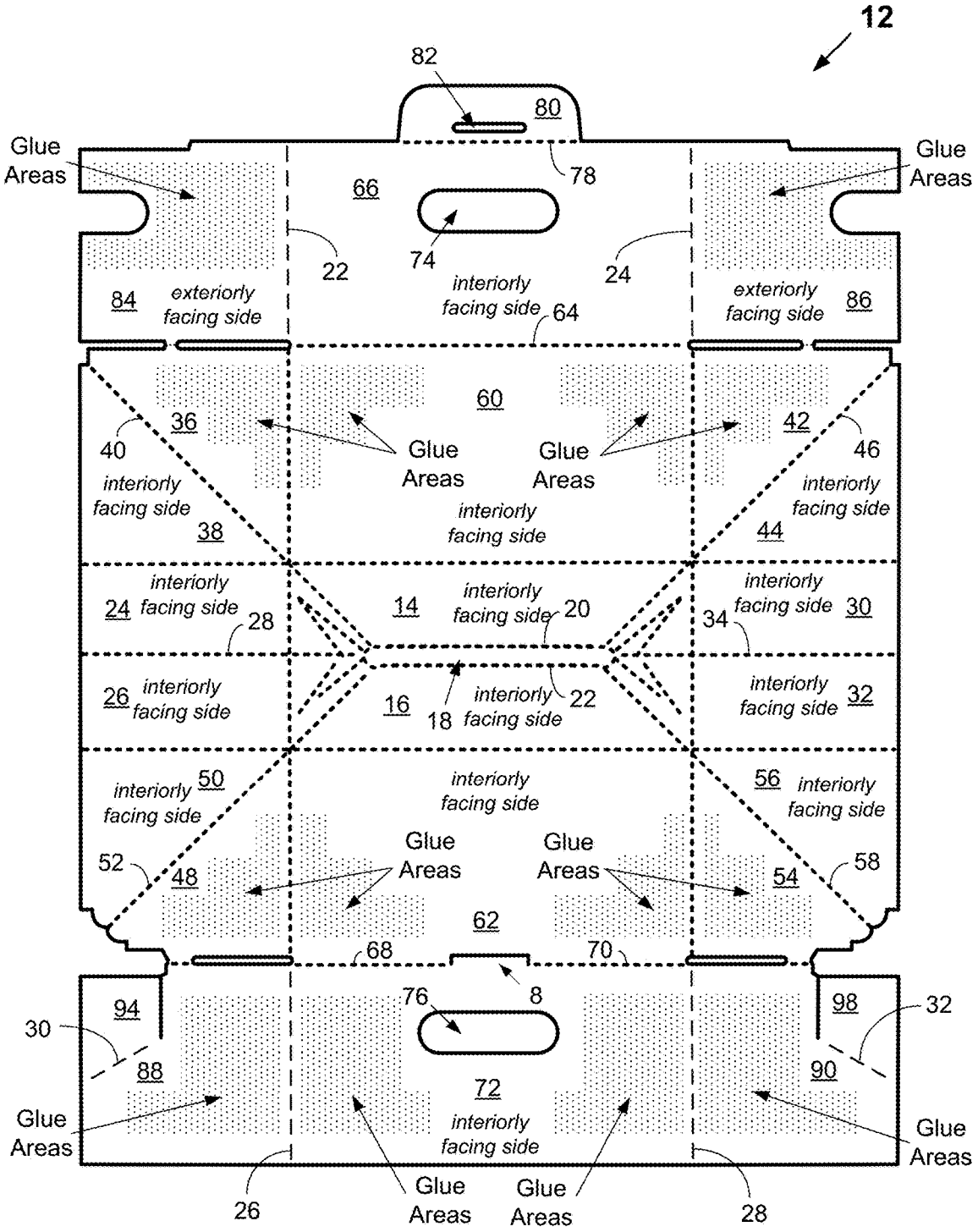
FIG. 1 is a plan view of a first side of a blank 12 used to make a box, of which the box 10 of FIG. 1 of U.S. patent application Publication 2022/0281633 A1 ("the '633 Publication") is representative.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "comprising" is open-ended insofar as that which follows such term is not exclusive. Additionally, "a" and "an" each generally denotes "at least one" but does not exclude a plurality unless the contextual use dictates otherwise. Thus, reference to "a picnic basket having an apple" is the same as "a picnic basket comprising an apple" and "a picnic basket including an apple", each of which identically describes "a picnic basket having at least one apple" as well as "a picnic basket having apples"; the picnic basket further may contain one or more other items beside an apple. In contrast, reference to "a picnic basket having a single apple" describes "a picnic basket having only one apple"; the picnic basket further may contain one or more other items beside an apple. In contrast, "a picnic basket consisting of an apple" has only a single item contained therein, i.e., one apple; the picnic basket contains no other item.

When used herein to join a list of items, "or" denotes "at least one of the items" but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers"; the picnic basket further may contain one or more other items beside cheese and crackers.

When used herein to join a list of items, "and" denotes "all of the items of the list". Thus, reference to "a picnic basket having cheese and crackers" describes "a picnic basket having cheese, wherein the picnic basket further has crackers", as well as describes "a picnic basket having crackers, wherein the picnic basket further has cheese"; the picnic basket further may contain one or more other items beside cheese and crackers.

The phrase "at least one" followed by a list of items joined by "and" denotes an item of the list but does not require every item of the list. Thus, "at least one of an apple and an orange" encompasses the following mutually exclusive scenarios: there is an apple but no orange; there is an orange but no apple; and there is both an apple and an orange. In these scenarios if there is an apple, there may be more than one apple, and if there is an orange, there may be more than one orange. Moreover, the phrase "one or more" followed by a list of items joined by "and" is the equivalent of "at least one" followed by the list of items joined by "and".

Additionally, as used herein, a "fold line" is intended to mean that along which something is folded and may comprise a "score line". A "score line" is intended to mean an elongated area along which a fold is predisposed to form upon application of force. Within this broader context, a score line may be a generally linear area of weakness formed in a corrugated or non-corrugated panel along which the panel is predisposed to fold upon application of a force on the panel. A score line may be formed by way of example, and not limitation, by notching, scratching, incision, compression, perforation, physical deformation, or otherwise.

Referring now to the drawings, one or more preferred embodiments of the invention are next described. The following description of one or more preferred embodiments is merely exemplary in nature and is in no way intended to limit the invention, its implementations, or uses.

Turning now to a discussion of a first preferred embodiment in accordance with one or more aspects and features of the invention, FIG. 1 of the '633 Publication, which is incorporated herein by reference, is a photograph of a box 10, and preferably a box having a water-resistant or waterproof coating applied for use as cooler, in accordance with one or more aspects and features of the invention. The box 10 is shown in FIG. 1 of the '633 Publication in an assembled, locked, use configuration. The box 10 preferably is assembled by folding and gluing a single sheet of corrugated cardboard material or "blank", to which the coating is applied.

Figure 2:
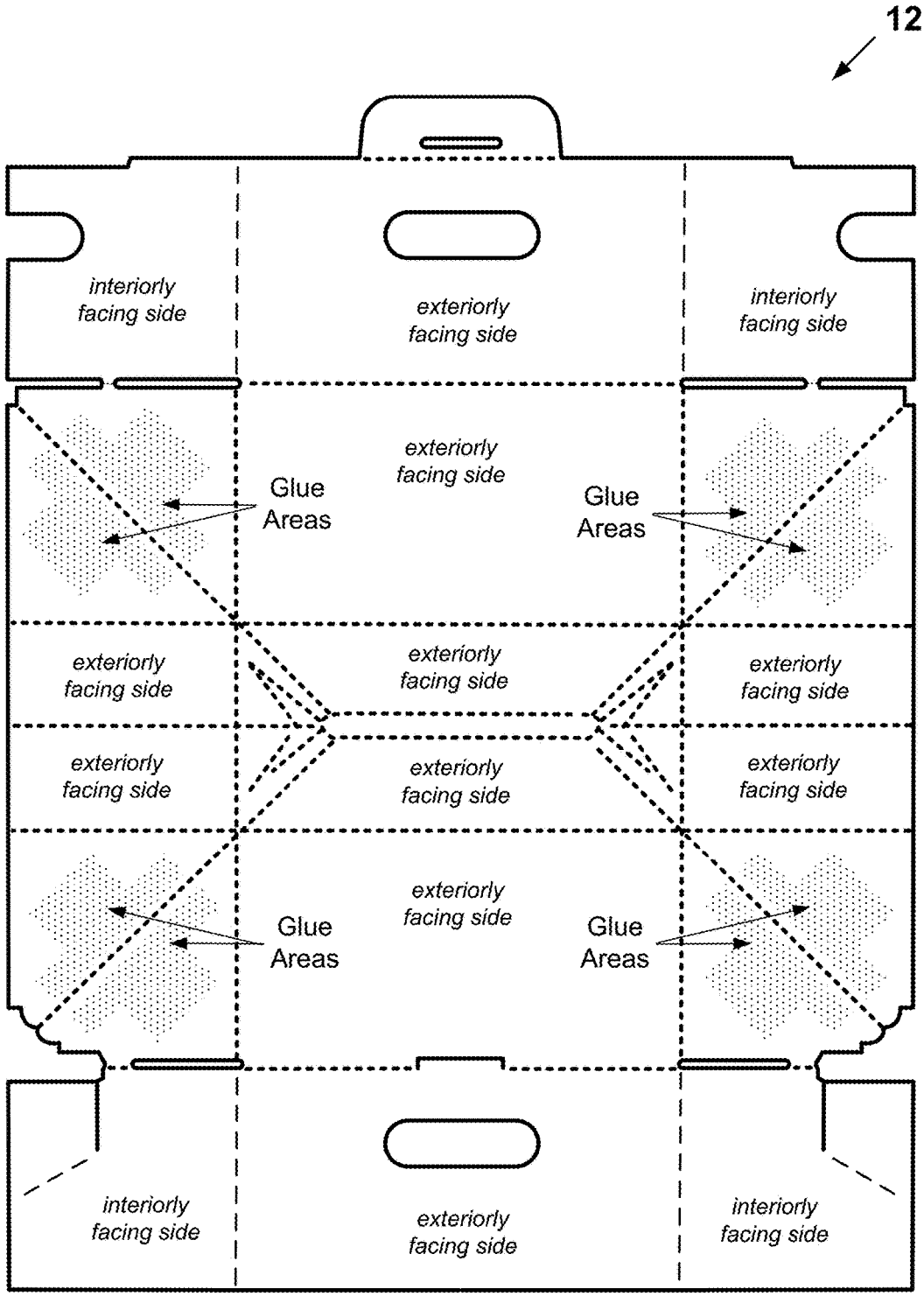
FIG. 2 is a plan view of the opposite side of the blank 12 of FIG. 1.

FIG. 1 herein is a plan view of a first side of a blank 12 used to make a preferred box of which the box 10 of FIG. 1 is representative, and FIG. 2 herein is a plan view of the opposite side of the blank 12. In these figures, fold lines are illustrated as dotted lines, and lines of perforations are illustrated as dashed lines. Thus, for example, there are six lines of perforations 22,24,26,28,30,32 in the blank 12. Moreover, FIG. 2A of the '633 Publication is a photograph of a blank 13 resulting from the disassembly of the box 10 of FIG. 1 of the '633 Publication and corresponds in view to the blank 12 as shown in FIG. 1 hereof; and FIG. 3A of the '633 Publication is a photograph of the opposite side of the blank 13 shown in FIG. 2A of the '633 Publication and corresponds in view to the blank 12 as shown in FIG. 2 hereof.

Additionally, shaded areas of the blank 12 indicate glue areas where glue is applied during assembly. Glue may be applied within the glue areas but may not be applied entirely throughout these glue areas, and glue may be applied in a glue area on both or just one side of a fold line or perforation line where that line extends through the glue area. The glue applied may be a conventional adhesive used to glue corrugated cardboard when assembly boxes at a high rate of speed when using a machine, such as disclosed in the incorporated '433 patent.

As will be evident from these figures, the fold lines and lines of perforations in the blank 12 extend between and define panels and subpanels of the blank 12. In particular detail, and with reference to FIG. 2, a bottom panel comprises bottom subpanels 14,16 separated and defined in part by a center elongate subpanel 18 that itself is defined in part by fold lines 20,22; a first end panel comprises end subpanels 24,26 defined in part by fold line 28 extending therebetween; and a second end panel comprises end subpanels 30,32 defined in part by fold line 34 extending therebetween.

Furthermore, the blank 12 further comprises: a first corner panel comprising corner subpanels 36,38 defined in part by fold line 40 extending therebetween; a second corner panel comprising corner subpanels 42,44 defined in part by fold line 46 extending therebetween; a third corner panel comprising corner subpanels 48,50 defined in part by fold line 52 extending therebetween; and a fourth corner panel comprising corner subpanels 54,56 defined in part by fold line 58 extending therebetween.

The blank 12 additionally comprises a front side panel 60 and a rear side panel 62.

A lid of the box is formed by overlapping top panels. In particular, a fold line 64 extends between and separates the front side panel 60 and a first top panel 66; and aligned fold lines 68,70 extend between and separate rear side panel 62 and top panel 72.

An elongate, U-shaped cut is formed and extends between and separates aligned fold lines 68,70; the U-shaped cutout defines a locking tab 8 (see FIG. 1 of the '633 Publication) when the blank 12 is assembled into the box and is in the locked, use configuration as represented in FIG. 1 of the '633 Publication.

Finger opening 74 is provided in top panel 66 and a corresponding finger opening 76 is provided in top panel 72; as shown at 6 in FIG. 1 of the '633 Publication, the finger openings 74,76 register with each other when the blank 12 is assembled into the box and is in the locked, use configuration, as represented in FIG. 1 of the '633 Publication. In this manner the finger openings 74,76 form a handhold for gripping the box.

A fold line 78 extends between and separates the top panel 66 and a locking panel 80. The locking panel 80 includes an opening preferably in the form of a slot 82 that is sized and dimensioned to receive the locking tab 8 when the blank 12 is assembled into the box and is in the locked, use configuration, as represented in FIG. 1 of the '633 Publication.

The perforation line 22 extends between and separates the top panel 66 and a first reinforcing panel 84; and the perforation line 24 extends between and separates the top panel 66 and a second reinforcing panel 86. Each reinforcing panel includes a U-shaped recess or cutout that corresponds to a portion of the finger opening 74 such that the reinforcing panels 84,86 do not obstruct the finger opening 74 when the reinforcing panels are folded and adhered to the top panel 66 for reinforcing support of the top panel 66.

Similarly, the perforation line 26 extends between and separates the top panel 72 and a third reinforcing panel 88; and the perforation line 28 extends between and separates the top panel 72 and a fourth reinforcing panel 90. The reinforcing panels 88,90 are folded about the respective perforation lines 26,28 and adhered to the top panel 72 during assembly of the box from the blank 12 for reinforcing support of the top panel 72.

Each of the third and fourth reinforcing panels includes an additional perforation line and a slit therein for defining a flap. In particular, reinforcing panel 88 includes perforation line 30 and slit 92 that defines flap 94; and reinforcing panel 90 includes perforation line 32 and slit 96 that defines flap 98. Each flap is hinged to its respective reinforcing panel and each flap pivots about its respective perforation line relative to its respective reinforcing panel.

When the blank 12 is assembled into the box and is in the locked, use configuration, as represented in FIG. 1 of the '633 Publication, the flaps 94,98 cover the opening on the inside of the cooler but are readily pushed inward when fingers are inserted into the opening for grasping of the box. When fingers are removed, the flaps tend to return to covering the opening due to resilience of the corrugated cardboard material, at least prior to first use and preferably for some period of time thereafter.

Figure 3:
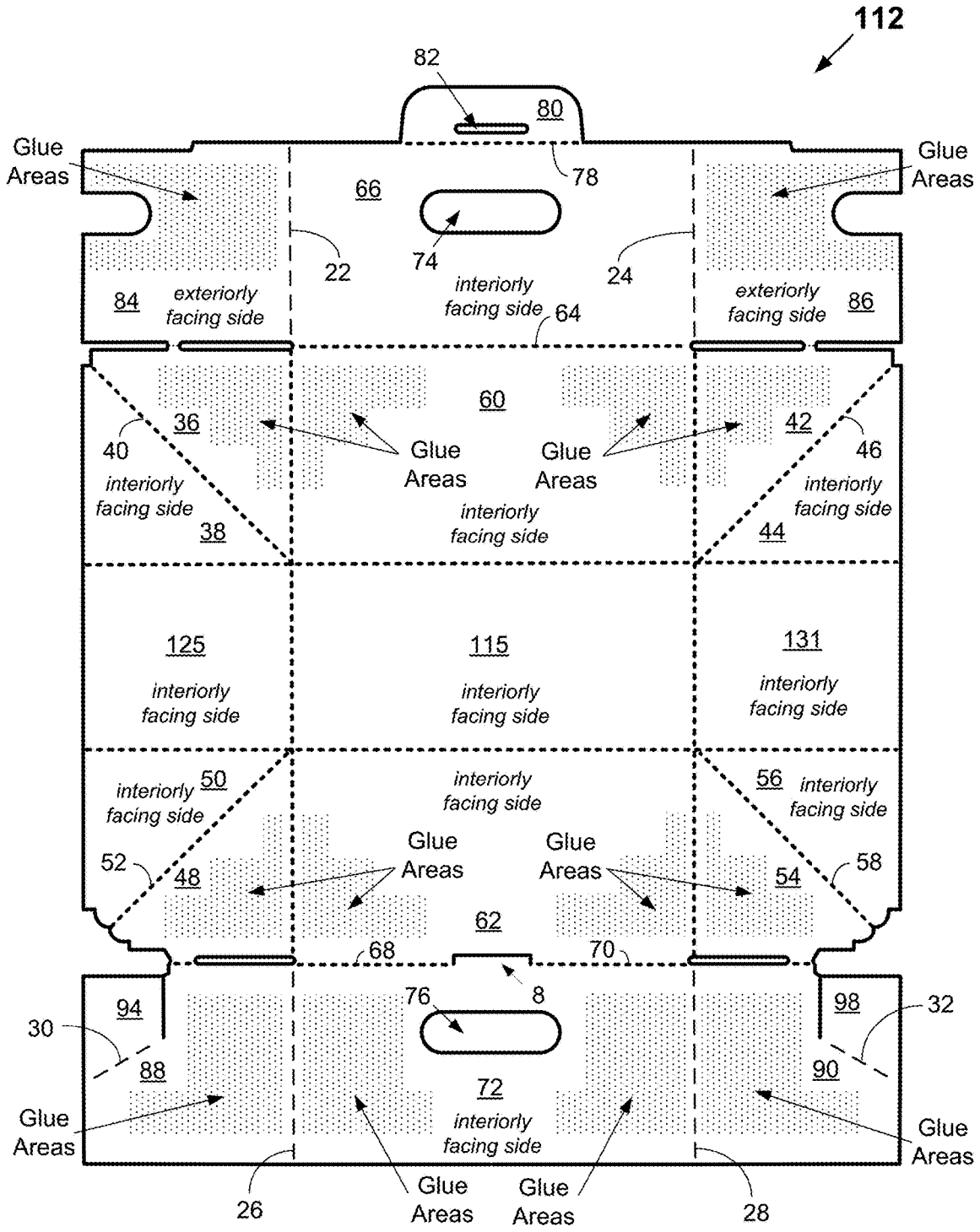
FIG. 3 is a plan view of a first side of a blank 112 used to make another preferred box in accordance with one or more aspects and features of the invention.
Figure 4:
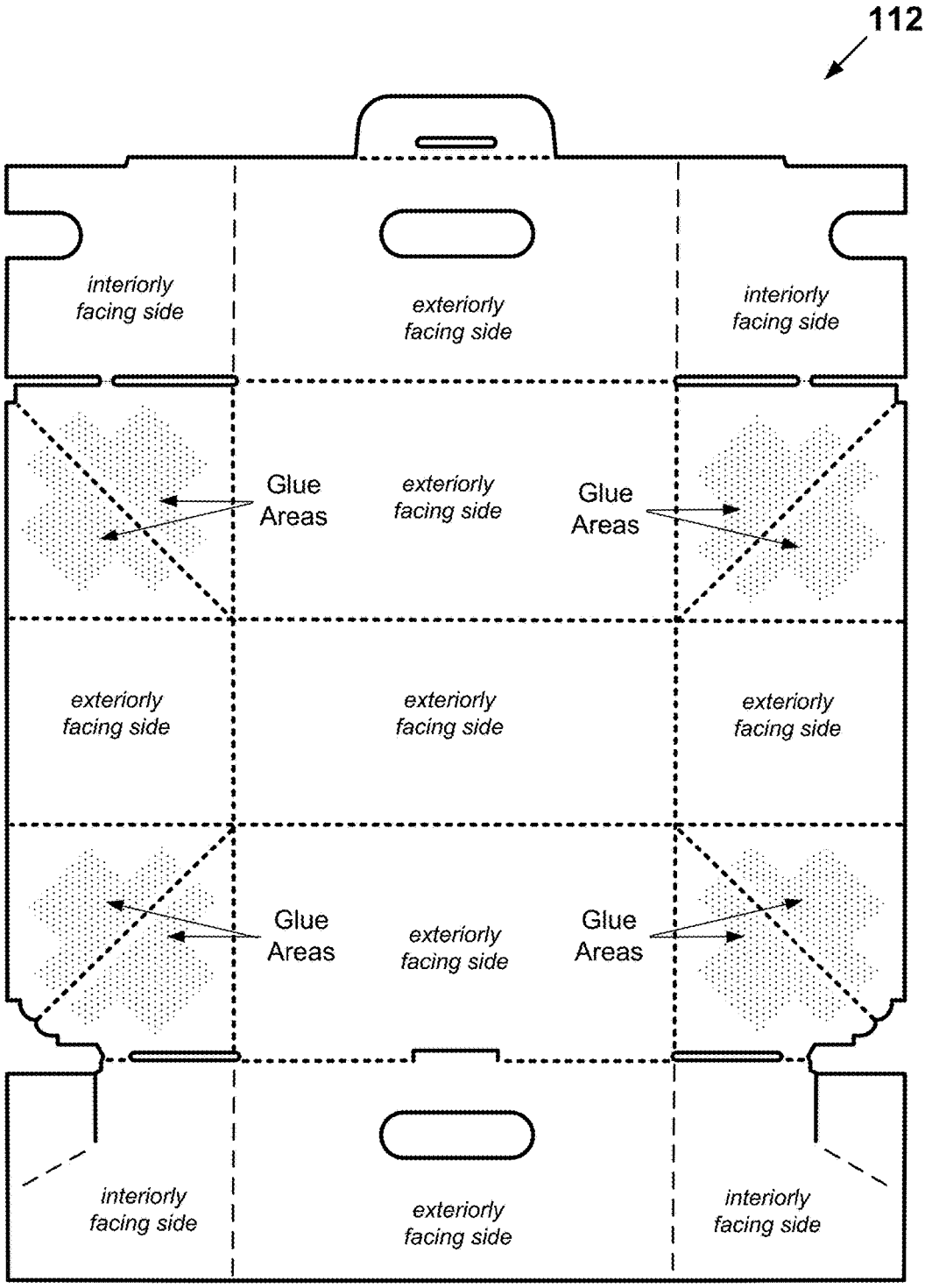
FIG. 4 is a plan view of the opposite side of the blank 112 of FIG. 3.

Another preferred embodiment of a blank 112 is shown in FIGS. 3 and 4 and is similar to that of FIGS. 1 and 2 with the exception of the omission of certain fold lines such that the box is not collapsible after being assembled for use. In particular the fold lines 20,22,28,34 and the center subpanel 18 found in blank 12 are omitted from blank 112, with blank 112 having a bottom panel 115 and end panels 125,131 without subpanels being defined therein. In all other respects the description above regarding blank 12 and callout reference numbers applies equally to blank 112.

Figure 5:
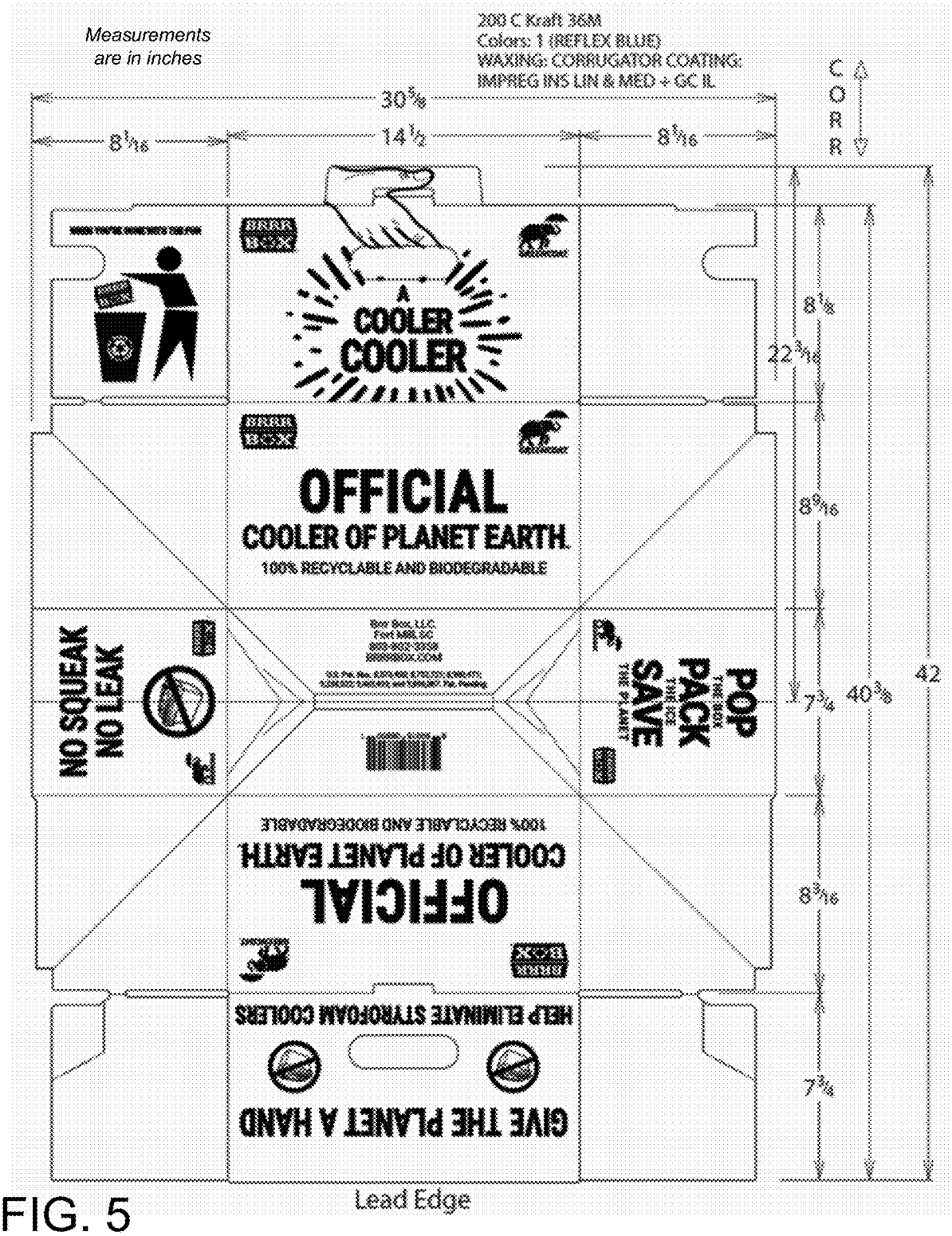
FIG. 5 is an illustration of a preferred commercial embodiment of a blank for making a preferred commercial box for use as a cooler in accordance with one or more aspects and features of the invention.

FIG. 5 is an illustration of a preferred commercial embodiment of a blank for making a preferred commercial box for use as a cooler in accordance with one or more aspects and features of the invention. Additionally, FIG. 7 of the '633 Publication is a perspective view of the preferred commercial box made from the blank of FIG. 5, shown in a collapsed state after being assembled; FIG. 8 of the '633 Publication is a perspective view of the preferred commercial box of FIG. 7 of the '633 Publication after being restored from the collapsed state; and FIG. 9 of the '633 Publication is a perspective view of the preferred commercial box of FIG. 8 of the '633 Publication having been filled with ice and beverage cans. FIG. 10 of the '633 Publication is a perspective view of the preferred commercial box of FIG. 9 after the lids have been closed and latched by extending the tab 8 of the inside top panel through the slot 82 of the outside top panel.

Based on the foregoing description, it will be readily understood by those persons skilled in the art that the present invention has broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A box comprising a bottom panel, a first end panel and a second end panel, a first side panel and a second side panel, and four corner panels, the box further comprising:

(a) a first top panel comprising a first finger opening for receiving fingers therethrough;

(b) a locking panel comprising an opening, wherein a fold line extends between and separates the first top panel and the locking panel;

(c) first and second reinforcing panels, wherein a fold line extends between and separates the first reinforcing panel and the first top panel, and wherein a fold line extends between and separates the second reinforcing panel and the first top panel;

(d) a second top panel comprising a second finger opening for receiving fingers therethrough, the first and second finger openings registering with each other to define a handhold opening when the box is in a closed configuration;

(e) third and fourth reinforcing panels, wherein a fold line extends between and separates the third reinforcing panel and the second top panel, and wherein a fold line extends between and separates the fourth reinforcing panel and the second top panel;

a locking tab, wherein the opening of the locking panel is sized and dimensioned to receive the locking tab therethrough; and (g) first and second flaps, with a fold line extending between and separating the first flap and the third reinforcing panel, and a fold line extending between and separating the second flap and the fourth reinforcing panel, wherein the first and second flaps at least initially cover the handhold opening when the box is in a closed configuration.

2. The box of claim 1, wherein each fold line that extends between and separates a said flap and reinforcing panel is a line of perforations.

3. The box of claim 1, wherein a waterproof or water-resistant coating is applied to an interior surface of the box for use of the box as a cooler.

4. The box of claim 1, wherein the box comprises one or more additional fold lines by which the box is collapsible.

5. The box of claim 4, wherein the one or more additional fold lines extend across a middle of each end panel and the bottom panel of the box.

6. A box comprising a bottom panel, a first end panel and a second end panel, a first side panel and a second side panel, and four corner panels, the box further comprising:

(a) a first top panel comprising a first finger opening for receiving fingers therethrough;

(b) a second top panel comprising a second finger opening for receiving fingers therethrough, the first and second finger openings registering with each other to define a handhold opening when the box is in a closed configuration;

(c) first and second reinforcing panels, wherein respective fold lines extend between and separate the reinforcing panels and the second top panel; and (d) first and second flaps, with a fold line extending between and separating the first flap and the first reinforcing panel, and a fold line extending between and separating the second flap and the second reinforcing panel, wherein the first and second flaps are configured to extend across and cover the handhold opening when the box is in a closed configuration.

7. The box of claim 6, wherein each fold line that extends between and separates a said flap and reinforcing panel is a line of perforations.

8. The box of claim 6, wherein the first and second top panels are located at opposite ends of the box.

9. The box of claim 6, wherein a waterproof or water-resistant coating is applied to a surface of the box for use of the box as a cooler.

10. The box of claim 6, wherein the box comprises one or more additional fold lines by which the box is collapsible, and wherein the one or more additional fold lines extend across a middle of each end panel and the bottom panel of the box.

11. The box of claim 6, wherein the box consists of a single sheet of corrugated cardboard for making the box by gluing and folding.

12. The box of claim 6, wherein the box comprises a single sheet of corrugated cardboard for making the box by gluing and folding.

13. A box, comprising a bottom panel, first and second end panels, first and second side panels, and four corner panels, the box further comprising:

(a) a first top panel comprising a first finger opening for receiving fingers therethrough;

(b) a second top panel comprising a second finger opening for receiving fingers therethrough, the first and second finger openings registering with each other to define a handhold opening when the box is in a closed configuration;

(c) first and second reinforcing panels, wherein respective fold lines extend between and separate the reinforcing panels and the second top panel; and (d) a locking tab and locking panel for latching the first and second top panels of the box when the box is in a closed configuration, wherein the locking panel is located along a side edge of the first top panel midway between the first and second reinforcing panels, and the locking tab is located midway along the second top panel between the third and fourth reinforcing panels;

wherein the box further comprises third and fourth reinforcing panels, wherein a fold line extends between and separates the third reinforcing panel and the second top panel, and wherein a fold line extends between and separates the fourth reinforcing panel and the second top panel; and first and second flaps, with a fold line extending between and separating the first flap and the third reinforcing panel, and a fold line extending between and separating the second flap and the fourth reinforcing panel, wherein the first and second flaps at least initially cover the handhold opening when the box is in a closed configuration.

14. The box of claim 13, wherein a waterproof or water-resistant coating is applied to a surface of the box for use of the box as a cooler.

15. The box of claim 13, wherein the box comprises one or more additional fold lines by which the box is collapsible, and wherein the one or more additional fold lines extend across a middle of each end panel and the bottom panel of the box.

* * * * *